United States Patent [19]

Dyson

[11] Patent Number: 5,062,870

[45] Date of Patent: Nov. 5, 1991

[54] SHUT-OFF DEVICE FOR CYCLONIC VACUUM CLEANER

[75] Inventor: James Dyson, Bathford, England

[73] Assignee: Notetry Limited, England

[21] Appl. No.: 549,080

[22] Filed: Jul. 6, 1990

[51] Int. Cl.[5] ..... B01D 39/12

[52] U.S. Cl. ..... 55/213; 55/215; 55/337; 55/345; 55/429; 55/459.3; 55/DIG. 3

[58] Field of Search ..... 55/213, 215, 216, 337, 55/345, 429, 432, 459.1, 459.3, DIG. 3

[56] References Cited

U.S. PATENT DOCUMENTS

| | | | |
|---|---|---|---|
| Re. 32,257 | 10/1986 | Dyson . | |
| 2,230,113 | 1/1941 | Hein . | |
| 2,649,927 | 8/1953 | Ortega | 55/216 |
| 2,758,670 | 8/1956 | Doughman et al. . | |
| 2,764,256 | 1/1956 | Allen . | |
| 2,814,358 | 11/1957 | Beede et al. . | |
| 2,817,414 | 12/1957 | Ferraris . | |
| 2,863,524 | 12/1958 | Buda . | |
| 3,172,743 | 3/1965 | Kowalewski . | |
| 3,626,545 | 12/1971 | Sparrow . | |
| 3,870,486 | 3/1975 | Eriksson et al. . | |
| 4,142,270 | 3/1979 | Nauta | 55/216 X |
| 4,246,676 | 1/1981 | Hallsworth et al. . | |
| 4,294,595 | 10/1981 | Bowerman . | |
| 4,373,228 | 2/1983 | Dyson . | |
| 4,377,882 | 3/1983 | Dyson . | |
| 4,571,772 | 2/1986 | Dyson . | |
| 4,573,236 | 3/1986 | Dyson . | |
| 4,593,429 | 6/1986 | Dyson . | |
| 4,623,366 | 11/1986 | Berfield . | |
| 4,643,748 | 2/1987 | Dyson . | |
| 4,826,515 | 5/1989 | Dyson . | |
| 4,853,008 | 8/1989 | Dyson . | |
| 4,853,011 | 8/1989 | Dyson . | |

*Primary Examiner*—Charles Hart

*Attorney, Agent, or Firm*—Ian C. McLeod

[57] ABSTRACT

A dual cyclonic vacuum cleaner device (10) including outer cylcone (11), inner cyclone (12), collecting receiver (13) and motor (14) and a valve (46) in a housing (38) which preferably closes a passage into an inlet scroll (27) leading to the inner cyclone when the outer cyclone is full is described. The valve rises to meet a ring stop (47) to cause the closure because of the differential pressure ($\Delta P$) between a pressure at an opening (45) and a pressure inside of the housing. The valve (46) prevents dirt laden air from entering directly into the shroud 31 which could plug the inner cyclone, put dirt in the vacuum motor and expel dirt laden air to the atmosphere.

37 Claims, 6 Drawing Sheets

Figure 1:
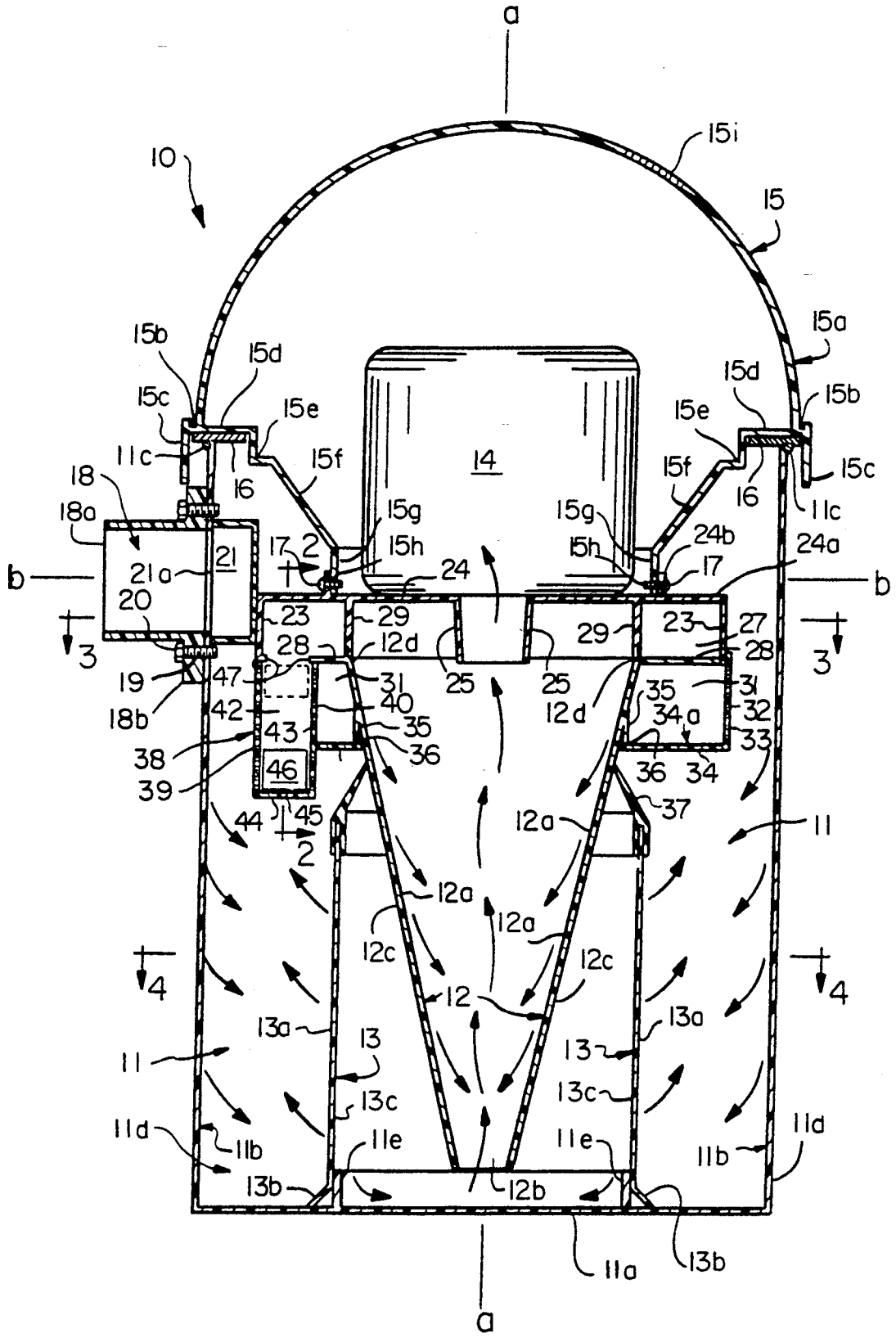

FIG. 4
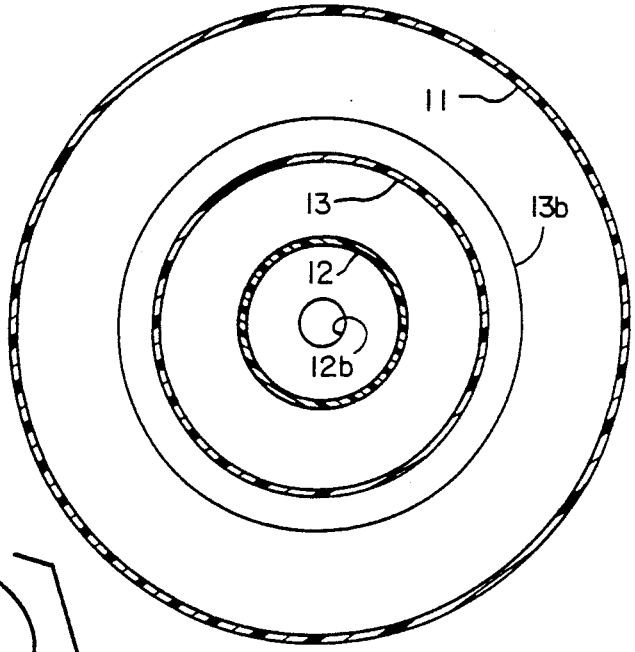
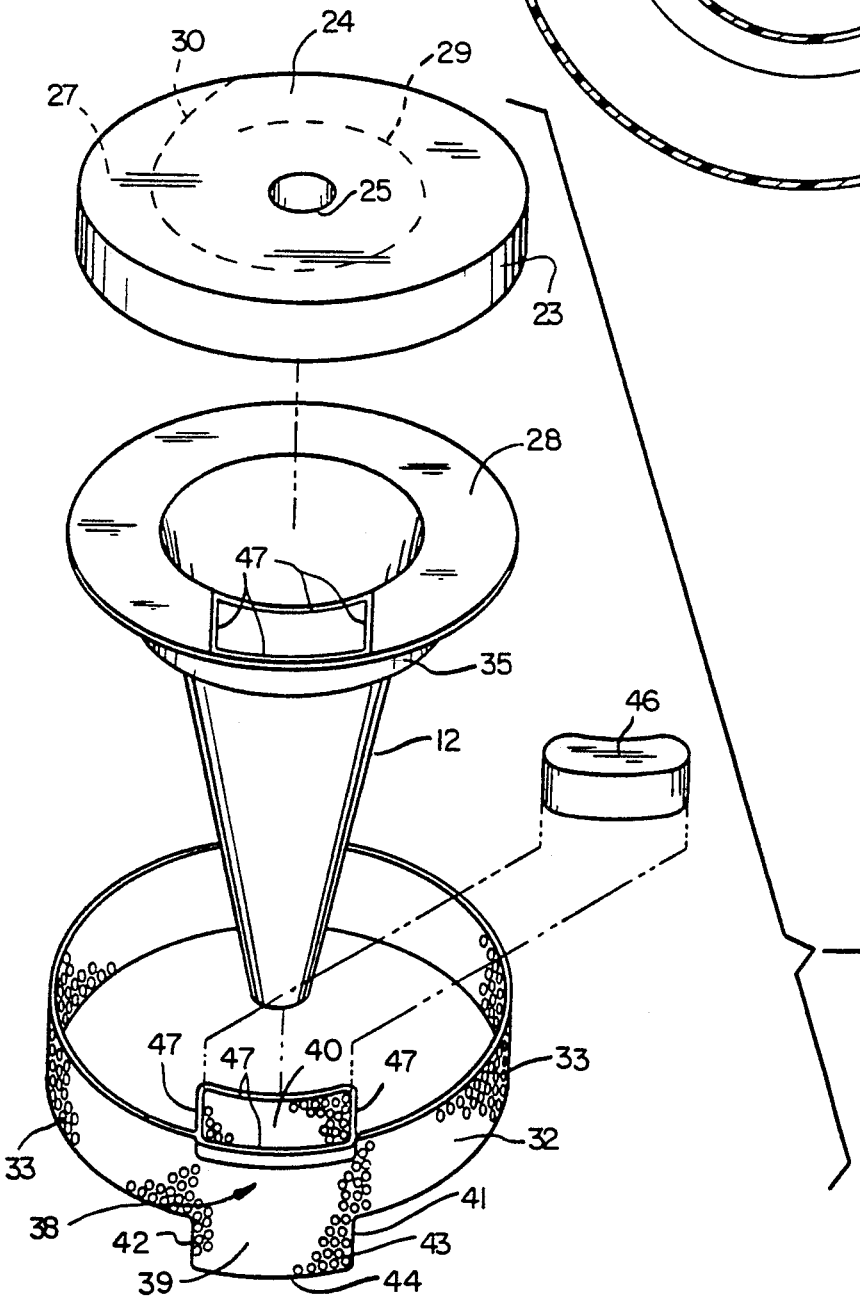
FIG. 5

SHUT-OFF DEVICE FOR CYCLONIC VACUUM CLEANER

BACKGROUND OF THE INVENTION (1) Field of the Invention

The present invention relates to an improved shut-off device which can be used in a single cyclone vacuum cleaner and which is preferably provided between cyclones in a dual outer and inner cyclonic vacuum cleaner. The shut-off device employs a valve means which becomes operational automatically when the outer cyclone becomes filled with dirt. The valve means shuts off the airflow between the two cyclones which prevents both fouling and damage to the motor fan unit drawing air through the cleaner and the exhausting of dirt laden air into the environment. Without the shut-off device, when the outer cyclone becomes full of dirt, additional use of the vacuum cleaner introduces dirt laden air into the inner cyclone still containing dirt particles that would have separated from the airflow had the outer cyclone been less than full. Also without the shut-off device, when the vacuum cleaner is full, additional use causes re-entrainment into the airflow entering the inner cyclone of dirt particles that had previously separated from the airflow in the outer cyclone. Therefore, the shut-off device is preferably positioned in the cleaner so as to shut off airflow to the inner cyclone when the outer cyclone becomes full of dirt.

(2) Prior Art

The prior art has described various types of devices that automatically indicate when the dirt or water level in a vacuum cleaner has reached a critical level. At that point, continued operation of the vacuum cleaner will result in ineffective or inefficient cleaning or it may cause damage to the motor fan unit. Illustrative patents are U.S. Pat. No. 2,230,113 to Hein; U.S. Pat. No. 2,758,670 to Doughman et al; U.S. Pat. No. 2,764,256 to Allen; U.S. Pat. No. 2,814,358 to Beede et al; U.S. Pat. No. 2,817,414 to Ferraris; U.S. Pat. No. 2,863,524 to Buda; U.S. Pat. No. 3,172,743 to Kowalewski; U.S. Pat. No. 3,626,545 to Sparrow; U.S. Pat. No. 3,870,486 to Eriksson et al; U.S. Pat. No. 4,246,676 to Hallsworth et al; U.S. Pat. No. 4,294,595 to Bowerman; and U.S. Pat. No. 4,623,366 to Berfield et al.

The prior art vacuum cleaner dirt level detection devices can be divided into two general categories. These devices have either floats that are designed to operate in vacuum cleaners which pick up liquids, or they have diaphragm devices that are affected by the difference in pressure between two points in the vacuum cleaner caused by the clogging of a vacuum cleaner dirt collecting bag. When the pressure differential reaches a threshold, the diaphragm triggers a sequence of mechanical or electrical steps which result in either the dust bag cover opening, a light or audible signal warning the operator to shut down the vacuum cleaner, or automatic powering down of the motor fan unit. U.S. Pat. No. 4,623,366 to Berfield et al is representative of the float type device. The float devices rely on the principle of buoyancy which causes a float to rise and seal against a seat when a sufficient amount of water has accumulated in the collection container of the vacuum cleaner. The float blocks the fan inlet opening so that even if the motor fan unit continues to run, additional water is not pulled into the system. These float devices are thus not designed to operate by sensing a differential air pressure on opposed sides of a valve.

U.S. Pat. No. 2,817,414 to Ferraris is a typical vacuum cleaner employing a differential pressure diaphragm, or sensor, which detects an increase in pressure between two points in the vacuum cleaner. In this device, pressure readings are taken between the inside and the outside of a dust collecting bag. As the bag fills with dirt, a differential force is exerted upon a control diaphragm. At a predetermined threshold, the diaphragm distorts and sets in motion a sequence of pneumatic, mechanical and/or electrical steps which de-energize the motor fan unit. These latter type of control devices are both complicated and expensive to manufacture.

Cyclonic vacuum cleaners are described in my U.S. Pat. Nos. 4,373,228; 4,377,882 (Re 32257); 4,573,236; 4,593,429; 4,571,772; 4,643,748; 4,826,515; 4,853,011 and 4,853,008. There is a need for a shut-off device for these vacuum cleaners.

OBJECTS

It is an object of the present invention to provide a shut-off device for a cyclonic vacuum cleaner. Further, it is an object of the present invention to provide a dual cyclonic vacuum cleaner wherein the separated dirt in an outer cyclone is prevented by a shut-off device from becoming re-entrained in the airflow leading to an inner cyclone when the outer cyclone is full. Further, it is an object of the present invention to provide a cyclonic vacuum cleaner wherein transmission to the inner cyclone of dirt particles that would have separated from the airflow had the outer cyclone been less than full is prevented by a shut-off device. Still further, it is an object of the present invention to provide a shut-off device in a cyclonic vacuum cleaner which is simple and economical to construct and which works in both wet and dry vacuum cleaners. These and other objects will become increasingly apparent by reference to the following descriptions and to the drawings.

IN THE DRAWINGS

FIG. 1 is a front cross-sectional view of a preferred tank type cleaning apparatus of the present invention and particularly showing an outer cyclone 11, an inner cyclone 12 and associated dirt collection receiver 13, and a shut-off valve 46 positioned in a housing 38 at an air inlet at A to the inner cyclone 12.

Figure 2:
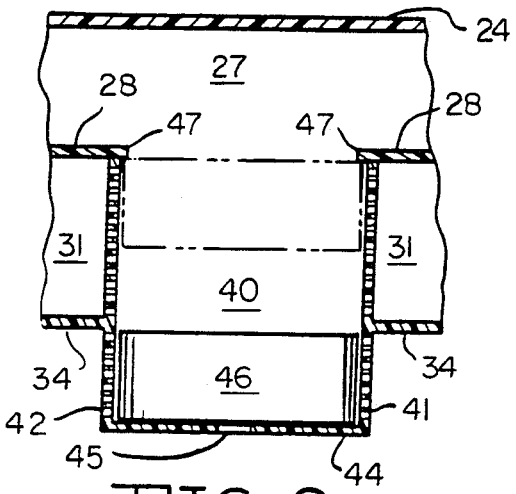

FIG. 2 is a front cross-sectional view along line 2—2 of FIG. 1 showing the valve 46 in housing 38.

Figure 2A:
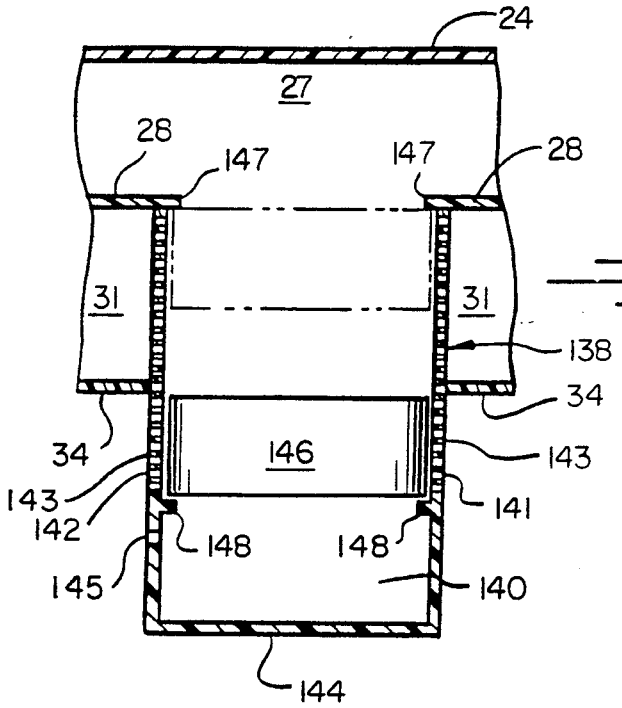

FIG. 2A is a front cross-sectional view showing a modified valve housing 138 and valve 146 in housing 138.

Figure 3:
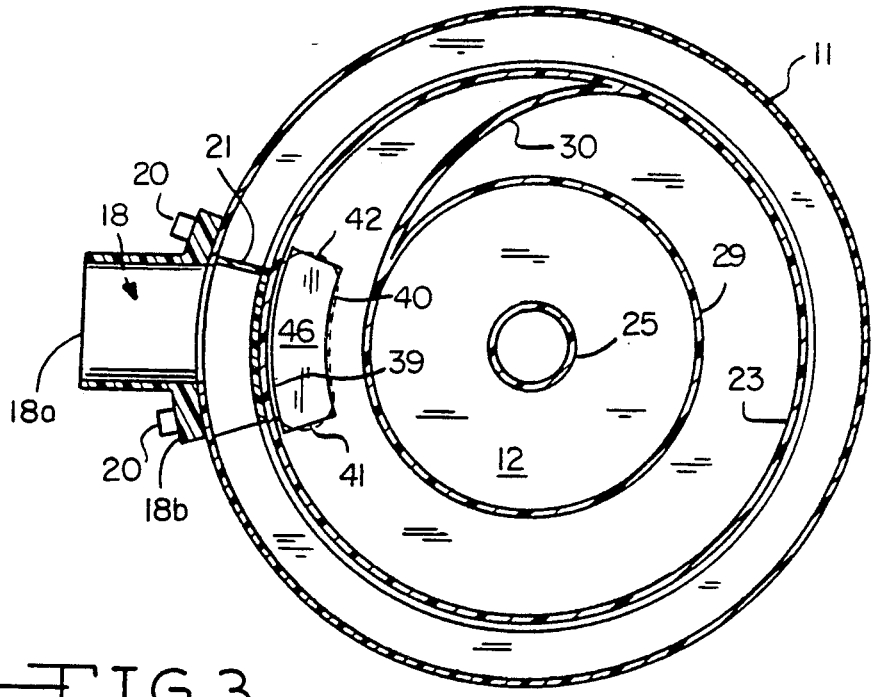

FIG. 3 is a plan cross-sectional view along line 3—3 of FIG. 1 showing the inlet passage 21 to the outer cyclone 11 with spiral member 30 for inlet into the inner cyclone 12.

Figure 3A:
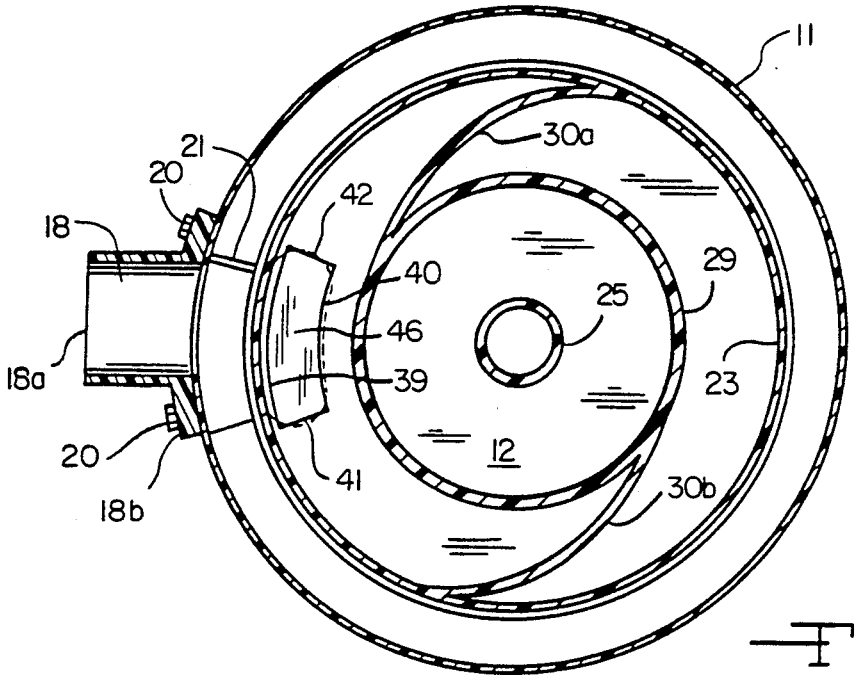

FIG. 3A is a plan cross-sectional view showing the inlet scroll 27 having two spiral members **30*a* and 30*b* rather than one as shown in FIG. 3**.

FIG. 4 is a plan cross-sectional view along line 4—4 of FIG. 1 showing the cross sections of the outer cyclone 11, inner cyclone 12 and dirt collection receiver 13.

FIG. 5 is an isometric, separated view of the inner cyclone 12, inlet scroll 27, ring 32 with openings 33, valve housing 38 with openings 43, and valve 46.

Figure 6:
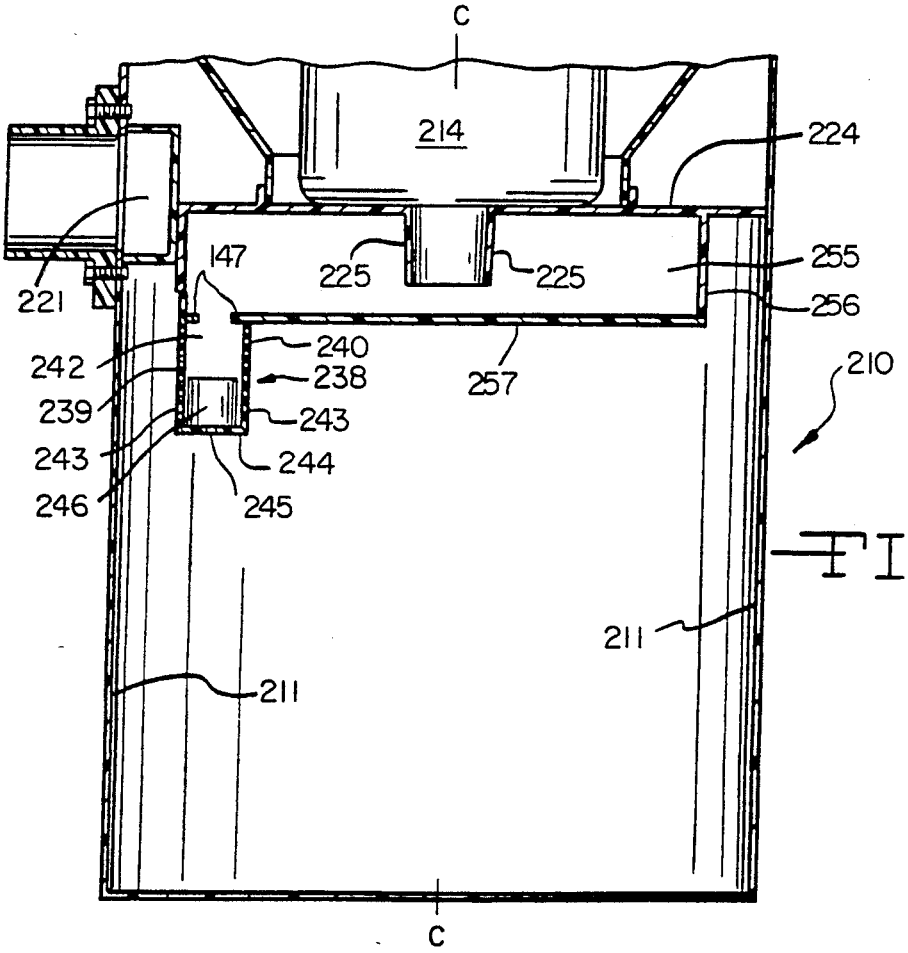

FIG. 6 is a front cross-sectional view of a tank type cleaning apparatus 210 of the present invention showing a single outer cyclone 211, valve housing 238 and valve 246.

Figure 7:
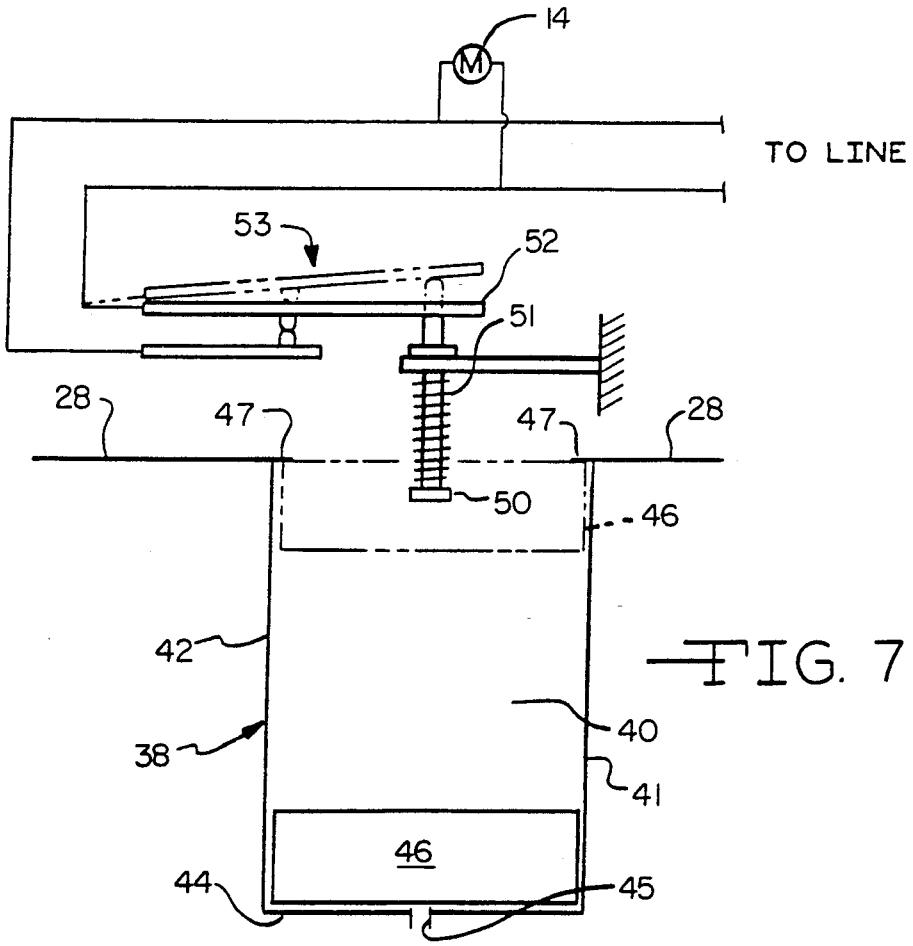

FIG. 7 is a cross-sectional view of another embodiment of the present invention wherein a switch 53 opens when contacted by valve 46 thereby cutting off power to motor fan unit 14.

Figure 8:
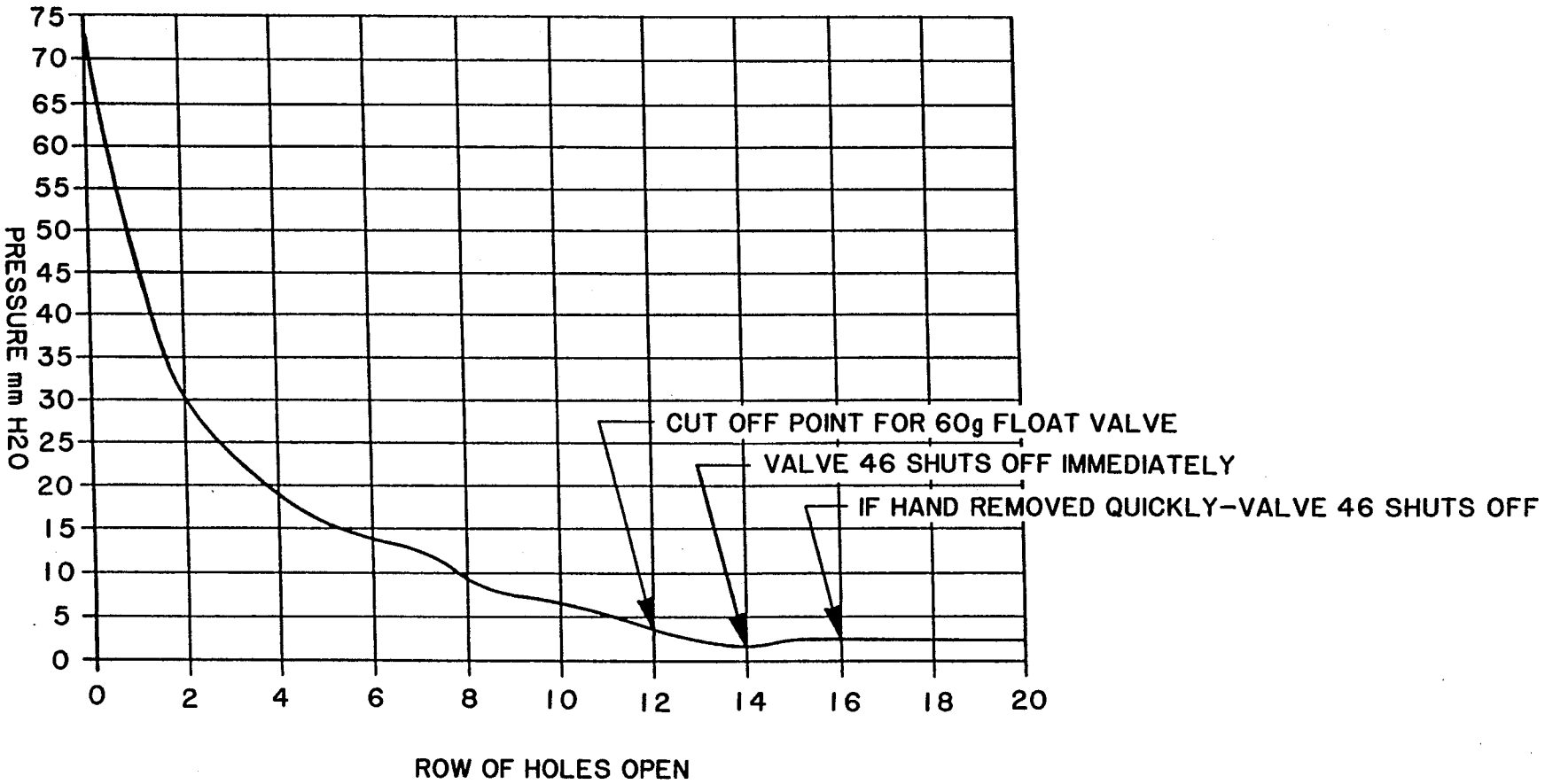

FIG. 8 is a graph showing area of openings 43 versus pressure drop across a shroud 31.

GENERAL DESCRIPTION

The present invention relates to a cleaning apparatus including a container comprising a bottom and sidewall extending to and meeting the bottom, the sidewall having an interior surface, a dirty air inlet at an upper portion of the container spaced from the bottom which is oriented for supplying dirt laden air into the container and having an air outlet from the container at the upper portion of the container; and means for generating an airflow which passes sequentially through the dirty air inlet and the container, and depositing the dirt in the container and then exiting from the container through a clean air outlet, the improvement in a dirt level sensing means comprising:

(a) housing means mounted inside the cleaner between the dirty air inlet and the clean air outlet having perforations through which the air flows between the air inlet and the air outlet; and (b) valve means slideably mounted inside the housing means wherein some of the perforations are below the valve means so that when at least some of the perforations are covered by dirt in the container, the valve means moves and stops airflow to the air outlet.

Further the present invention relates to a cleaning apparatus including a container comprising a bottom and sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and having an air outlet from the container at the upper portion of the container; a circular cross-sectioned cyclone having a longitudinal axis and mounted inside the container, the cyclone comprising a cyclone air inlet at an upper end and having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface, and a cyclone air outlet communicating with the interior of the cyclone adjacent the upper end of the cyclone; a dirt receiver extending from the cone opening; and means for generating an airflow which passes sequentially through the dirty air inlet, the container, the cyclone air inlet, the cyclone, the receiver and the cyclone air outlet, the airflow rotating around the frusto-conical interior surface of the cyclone and depositing the dirt in the receiver the improvement which comprises:

shroud means providing the air outlet from the container provided around the axis of the cyclone and having multiple perforations leading to an enclosed space inside the shroud means for providing air to the air inlet of the cyclone; and a dirt level sensing means mounted in the enclosed space of the shroud means and including a housing means, the housing means having perforations and including a valve means slideably mounted in the housing means, wherein at least some of the perforations are below the valve means and wherein in operation of the cleaner the valve means rests in the housing means as dirt is being accumulated in the container and when dirt in the container covers the perforations of the shroud means the valve rises in the housing means to close the air inlet to the cyclone.

The cleaner is preferably constructed substantially of plastic of known types, except for the motor and fasteners. The valve means is preferably constructed of a plastic such as polystyrene, ABS (poly(acrylonitrile-butadiene-styrene)), polypropylene, polyethylene, polycarbonate, acetyl, nylon or even a foam material, that rises when the perforations are covered by the dirt.

SPECIFIC DESCRIPTION

FIG. 1 shows a tank type vacuum cleaning apparatus 10, which comprises an outer cyclone 11, around an inner cyclone 12, a dirt collection receiver 13 and a motor driven fan unit 14. The inner and outer cyclones 11 and 12 have circular cross-sections along a longitudinal axis a—a. The outer cyclone 11 has a base **11*a* and a cylindrical inner surface 11*b* which extends from the outer periphery of the base 11*a*. A circular cross-sectioned flange 11*c* extends radially outwardly from the upper end part of the outside wall 11*d* of outer cyclone 11 and serves as one-half of a seal for the cyclone 11**.

A removable cover 15 with hemispherical outer surface **15*a* fits over the top of outer cyclone 11. The lower edge of the outside surface of cover 15 has an annular rim 15*b* with a depending lip 15*c* which serves as a hand grip for removing the cover 15 from the outer cyclone 11. Extending inward from rim 15*b* toward the axis a—a is a horizontal support web 15*d* which meets the upper edge of a right angle cross-sectioned protrusion 15*e*. An annular gasket 16 is mounted intermediate protrusion 15*e* and rim 15*b* on web 15*d* so as to be in contact with circular cross-sectioned flange 11*c*. The gasket 16 serves to seal the cover 15 to the outer cyclone 11 while the apparatus 10 is in operation. The lower edge of protrusion 15*e* meets the top edge of frusto-conical section 15*f* which tapers radially inwardly and downwardly toward the axis a—a. An annular ring member 15*g* depends from the distal end of conical section 15*f* and has openings 15*h* for bolts 17. Openings 15*i* are provided on the hemispherical surface 15*a* which serve as an exhaust port for motor fan unit 14**.

A cylindrical dirty air inlet passage 18 communicates through the upper part of the outside wall **11*d* of cyclone 11. The end part 18*a* of the dirty air inlet passage 18, remote from the outer cyclone 11, is joined by a flexible tube (not shown) to a cleaner head (not shown) for contacting a dirty surface. Flanged section 18*b* of inlet passage 18, adjacent to the outside wall 11*d* of cyclone 11, has openings 19 for bolts 20 to secure the inlet passage 18 to the outside wall 11*d* of cyclone 11. Inlet passage 18 leads to a dirty air inlet passage 21. As long as inlet passage 21 communicates through the upper part of the outside wall 11*d* of outer cyclone 11 so as to make a tangential entry and to set up a swirling, cyclonic flow of air in the outer cyclone 11, the exact position of the inlet passage 21 around the circumference of the outer cyclone 11** is not critical.

A plate 24, circular in plan view, with dependent tube 25 centered around axis a—a is positioned above the inner cyclone 12. The dependent tube 25 extends downwardly along axis a—a from the plate 24 substantially coaxially with the inner cyclone 12. The motor driven fan unit 14 is located on the plate 24 and is arranged so as to draw air from the inner cyclone 12 through dependent tube 25. Extending from the top side 24*a* of the plate 24 is annular ring member 24*b* which is outside of and adjacent to depending ring member 15*g*. Annular ring 24*b* has openings 26, centered on the axis b—b coinciding with openings 15*h* in depending ring member 15*g*, which enables bolts 17 to secure the cover 15 to the plate 24.

The inner cyclone 12 has a frusto-conical body extending radially downwardly and inwardly towards axis a—a and a dependent inlet scroll 27. The inner cyclone 12 comprises an inside wall 12*a* leading to a cone opening 12*b* and an outside wall 12*c*. The inlet scroll 27 comprises the sleeve 23 which depends from the plate 24 to a horizontal annular web 28 (FIGS. 1 and 3). The web 28 extends between the upper end 12*d* of the frusto-conical body and the lower end part of sleeve 23. A second dependent sleeve 29 extends between the cover 24 and the junction of the upper end 12*d* of the frusto-conical body and the web 28. The second sleeve 29 is located radially inwardly of the tubular sleeve 23 and through the majority of its length sleeve 29 extends from the upper end 12*d* of the frusto-conical body where upper end 12*d* joins the inner periphery of the web 28. As shown in FIG. 3, a portion 30 of the second sleeve 29 extends, in the form of a spiral, from the junction of the upper end 12*d* of the frusto-conical body and the web 28 to the tubular sleeve 23 thereby completing the inlet scroll 27 and providing a tangential entry to the inner cyclone 12 in order to be capable of setting up a swirling cyclonic flow of air.

FIG. 3A shows another version of the inlet scroll 27 where two diametrically opposed sections 30*a* and 30*b* extend from the junction of the upper end 12*d* of the frusto-conical body and the web 28 to tubular sleeve 23. In this manner, the inner cyclone 12 is provided with two opposed tangential entry points which are capable of setting up a swirling, cyclonic flow of air. It should be noted, that the inlet scroll 27 can be completed by any number of sections 30 spiraling radially outwardly from sleeve 29 to tubular sleeve 23 as long as the sections 30 create a tangential entry point to the inner cyclone 12.

Depending from scroll 27 and spaced from the outside wall 12*c* of the inner cyclone 12 is a shroud 31 which comprises of tubular ring 32 that depends from the junction of tubular sleeve 23 and web 28. The ring 32 of shroud 31 is totally perforated with a plurality of openings 33 (partially shown in FIG. 5) that serve as an air outlet from the outer cyclone 11 to scroll 27 leading into the inner cyclone 12. The tubular ring 32 is parallel to and purposely spaced from the inner surface 11*b* of the outer cyclone 11. For upright vacuum cleaners, the distance range is preferably between 0.59 inches to 1.18 inches (15 mm to 30 mm) and for tank type vacuums the distance range is preferably between 0.75 inches to 1.26 inches (20 mm to 32 mm). The exact distance between the tubular ring 32 and the inner surface 11*b* of the outer cyclone 11 is dependent on the diameters of the outer cyclone 11 and the inner cyclone 12. The shroud 31 is completed by a web 34 that extends between the lower end portion of ring 32 and the outside wall 12*c* of inner cyclone 12 and a cylindrical support member 35 that depends from the outside wall 12*c* of cyclone 12 and which with the upper surface 34*a* of web 34 forms a right angle closure from outer cyclone 11 at intermediate seal 36.

The dirt collection receiver 13 for the inner cyclone 12 comprises a cylindrical portion 13*a* which meets the upper edge of a frusto-conical section 13*b* extending downwardly and outwardly from the axis a—a to the base 11*a* of outer cyclone 11. Adjacent to and radially inward from frusto-conical section 13*b* is annular ring member 11*e* of outer cyclone 11 which extends beyond the upper edge of frusto-conical section 13*b* adjacent to the inside wall 13*c* of receiver 13, thus forming a seal between receiver 13 and outer cyclone 11. The cylindrical portion 13*a* is intermediate the inner surface 11*b* of the outer cyclone 11 and the outside wall 12*c* of the inner cyclone 12 and is below the web 34 of shroud 31. The receiver 13 is completed by a rubber seal 37 that extends from the top of the cylindrical portion 13*a* to the outside wall 12*c* of the inner cyclone 12 adjacent to web 34. In another embodiment (not shown), cylindrical portion 13*a* can meet and seal against web 34 of shroud 31.

A rectangular cross-sectioned valve housing 38 (radially and parallel to axis a—a) depends from the scroll 27 and interrupts the integrity of shroud 32 preferably adjacent to the air inlet passage 21. The valve housing 38 includes spaced apart arcuate side walls 39 and 40 (FIG. 5), right lateral wall 41 and left lateral wall 42 all of which are totally perforated with a plurality of openings 43 that serve as the air outlet from the outer cyclone 11 to scroll 27 leading into inner cyclone 12. However, it should be noted that even though the housing 38 interrupts the integrity of the ring 32 of shroud 31, the sidewall 39 of housing 38 and ring 32 form a continuously perforated ring. The valve housing 38 is completed by a bottom wall 44 which has a single opening 45. The valve housing 38 extends from the bottom side of web 28 to a distance below the web 34. The web 34 could be adjacent to bottom wall 44 (not shown). The valve housing 38 provides for a rectangular cross-sectioned (radially and parallel to axis a—a) valve member 46 that is in slideable relationship with the inside walls of the valve housing 38. While at rest on the bottom wall 44 of the valve housing 38, the valve 46 covers opening 45.

All air leaving the outer cyclone 11, whether through side walls 39, 40, 41 and 42 of valve housing 38 or through ring 32 of shroud 31 and then the valve housing 38, merges at the top of the valve housing 38 before entering the inlet scroll 27 leading into the inner cyclone 12. Which exit route the air takes is largely dictated by which of the openings 33 through ring 32 of shroud 31 or openings 43 through valve housing 38 block off as the level of separated dirt accumulates in the outer cyclone 11. The actual interaction between the air exiting the outer cyclone 11 and the valve housing 38, valve 46 and shroud 31 is described more fully hereinafter.

FIG. 2A depicts another embodiment of a valve housing 138 depending from inlet scroll 127. Valve housing 138 includes spaced apart arcuate side walls (only 140 shown), right lateral wall 141 and left lateral wall 142 all of which are perforated with a plurality of openings from about 2 inches (50.8 mm) below stop ring 147 to stop ring 148 which is about 0.5 inches (12.7 mm) above bottom wall 144. Lateral wall 142 has a single opening 145 below stop ring 148 which functions similarly to opening 45 in valve chamber 38. The valve housing 138 provides for a rectangular cross-sectioned (radially and parallel to axis a—a) valve member 146 that is in slideable relationship with the inside walls of the valve housing 138. Valve housing 138 operates in substantially the same manner as valve housing 38 described in FIG. 1, except that valve chamber 138 can be removable from inlet scroll 127 by clips or other means (not shown) so that accumulated dirt below opening 145 in lateral wall 142 can be emptied.

FIG. 6 shows another version of the present invention wherein the vacuum cleaning apparatus 210 has only one cyclone 211 and an associated outlet chamber 255. The outlet chamber 255 is formed by plate 224 with dependent tube 225 centered around axis c—c and depending annular ring member 256. A plate 257, circular in plan view, meets the lower edge of the ring 256 thereby completing the chamber 255. The integrity of plate 257 is interrupted by a rectangular cross-sectioned valve housing 238 with accompanying valve 246. The valve housing 238 is formed of spaced apart arcuate side wall 239 and 240, right lateral wall (not shown) and left lateral wall 242 as in FIG. 1, all of which are totally perforated with a plurality of opening 243 A base wall 244 with a single opening 245 completes the valve housing 238. Operation of the cleaning apparatus of FIG. 3A is similar to the apparatus of FIG. 1, in that when valve 246 contacts stop 147, the airflow between cyclone 211 which enters through the dirty air inlet passage 221 and the airflow exhausting through tube 225 is cut off, indicating that motor fan unit 214 should be turned off so that the separated dirt in cyclone 211 can be emptied.

FIG. 7 shows another embodiment of the valve housing 38 and valve 46 used to cut off the flow of air between the outer cyclone 11 and the inner cyclone 12. The valve 46 rises in the valve housing 38 until it contacts ring stop 47 and a plunger 50 which is normally biased downwardly by a spring 51. The plunger 50 then engages an upper switch arm 52, of a switch 53 causing the switch 53 to open which turns off the power to the motor fan unit 14.

OPERATION

At some point during the continued operation of the vacuum cleaning apparatus 10, the outer cyclone 11 becomes so full of separated dirt that the outer cyclone 11 will cease to function properly. Without valve 46, an airflow is created between the top of the separated dirt in the outer cyclone 11 and the inlet scroll 27 of the inner cyclone 12. This airflow causes large dirt particles that had previously separated from the air stream in the outer cyclone 11 to become re-entrained in the air entering the inner cyclone 12. The airflow also causes transmission to the inner cyclone 12 of dirt particles that would have separated from the airflow had the outer cyclone 11 been less than full. Because the inner cyclone 12 is only designed to separate out fine dirt particles from the air stream, these large dirt particles will then be expelled out of dependent tube 25, fouling the motor fan unit 14 and contaminating the air exhausted into the atmosphere. With valve 46, the pressure gradient ($\Delta P$) between opening 45 and the inside of housing 38 causes the valve 46 to rise and meet ring stop 47, thereby preventing the air from passing into inner cyclone 12.

The present invention takes advantage of the pressure gradient ($\Delta P$) between the inside of housing 38, and the outside of housing 38 and particularly between the outside of housing 38 and the opening 45 caused by the flow of air directly inside of housing 38. The housing 38 has the single large opening 45 in the base wall 44 and the plurality of smaller openings 43 in the side walls 39, 40, 41, and 42. All the air leaving the outer cyclone 11 and entering the inner cyclone 12 takes one of two routes. One route leads through the sidewalls 39, 40, 41 and 42 of valve housing 38 while the other travels through ring 32 of shroud 31 before entering the valve housing 38. Both routes then merge at the top of valve housing 38 before entering the inlet scroll 27 of the inner cyclone 12. Which exit route from the outer cyclone 11 the airflow takes is largely dictated by whether the openings 33 through ring 32 of shroud 31 or openings 43 through valve housing 38 are blocked off.

When none of the openings 43 and 33 are blocked, substantially all the air passes directly from the outer cyclone 11 into the valve housing 38 thereby bypassing shroud 31. If the shroud 31 becomes partially blocked so that the airflow through ring 32 above the valve housing 38 becomes restricted, a drop in pressure occurs above the valve housing 38 and valve 46. This creates a surge in pressure in the air stream passing directly past the valve housing 38 from the outer cyclone 11 which creates a pressure gradient ($\Delta P$) between the outer cyclone 11 and the inlet scroll 27 leading to the inner cyclone 12. This pressure gradient ($\Delta P$) exerts a force on the valve 46 from below the housing 38 through the base wall opening 45 which is greater than the force exerting on the sides and the top of the valve 46 through the side wall openings 43. The pressure gradient ($\Delta P$) causes the valve 46 to lift upwards until it contacts the ring stop 47, cutting off the flow of air between the outer cyclone 11 and the inner cyclone 12.

Alternatively, when the openings 43 through the side walls 39, 40, 41, and 42 of the valve housing 38 which projects below the shroud 31 become partially blocked with dirt, the airflow past the valve housing 38 is reduced and the airflow above the valve housing 38 from the shroud 31 is increased. This creates a pressure gradient ($\Delta P$) between the outer cyclone 11 and the inlet scroll 27 as was explained above. This pressure ($\Delta P$) gradient causes the valve 46 to lift in valve housing 38 until the valve 46 contacts ring stop 47, again cutting off the flow of air between the outer cyclone 11 and the inner cyclone 12 and allowing the full force of the motor fan unit 14 to draw against the valve 46. Because of this, the valve 46 must not only be constructed of a light weight material that will respond to the before mentioned pressure gradient ($\Delta P$), but the valve 46 must be made of a material that is strong enough to withstand the full force of the motor fan unit 14.

The number of the openings 43 through the valve housing 38 in side walls 39, 40, 41 and 42, the size of opening 45 in the base wall 44, and the make-up of the valve 46 are important to the proper operation of the valve housing 38. It was found through experimentation that if opening 45 through the base wall 44 of valve housing 38 was between about 0.39 to 0.59 inches in diameter (10 mm to 15 mm) that the operation of valve 46 was improved. The valve chamber had 56 holes per row and 21 rows which equals 1176 holes of 1.21 square millimeters each. The opening 45 had a cross-sectional area between about 0.121 to 0.274 square inches (78 to 176 square millimeters) and the openings 43 a cross-sectional area of about 2.21 square inches (1423 square millimeters). Thus the ratio of areas is between about 8 to 1 to 19 to 1.

The ring 32 preferably had 31 rows of 102 holes per row for a total of 3162 perforations. At 1.21 square millimeters per hole, this provides an area of openings 43 of 5.94 square inches (3826 square millimeters) compared to 0.121 to 0.274 square inches (78 to 176 square millimeters) for the opening 45. Optimally the openings 43 are staggered between rows 0.255 inches (6.5 mm) apart horizontally and 0.146 inches (3.7 mm) apart vertically between centers of the openings 43.

The vacuum cleaning apparatus is easily disassembled for emptying and cleaning. Latches are not shown and are outside of the vacuum cleaner between the cover 15 and cyclone 11. After unlatching the cover 15 from the outer cyclone 11, the operator holds rim **15*b* and lifts the cover 15 by exerting an upward force on the rim 15*b*. This causes the vacuum cleaner 10 to separate into its two main sections. The cover 15, motor fan unit 14, inlet scroll 27, shroud 31 and inner cyclone 12 are built as an integral section and they will separate from the dirt collection receiver 13 and outer cyclone 11. This breakdown allows the operator to set the cover 15 and inner cyclone 12 section aside so that the outer cyclone 11 and dirt collection receiver 13** can be emptied of dirt and cleaned.

To re-assemble the vacuum cleaner 10, the operator sets the cover 15 and inner cyclone 12 section on top of the outer cyclone 11 and dirt collection receiver 13 section. Making certain that the two main sections are properly lined up, the operator applies a firm downward force to the cover 15. The cover 15 and inner cyclone 12 section can then be latched (not shown) into place with the inner cyclone 12 sealing against rubber seal 37 and the cover 15 sealing against annular gasket 16.

The following are parameters for the preferred vacuum cleaner:

1. Number of Holes In Shroud 31

FIG. 8 is a graph of the area of openings 33 in shroud 31 versus the pressure gradient ($\Delta P$) between the inside of housing 38 and the outside of housing 38 and particularly between the inside of housing 38 and the opening 45. It was found that there should be approximately the number and size of openings 33 in shroud 31 to position the pressure at which valve 46 activates as far along from the pressure increase rise of the graph as possible Where there were approximately 220 holes per row, a combination lying in the range of 21 to 32 rows of holes of 2.2 mm diameter were found to be best. A 2.2 mm diameter hole is sufficiently small to block the passage of particles of a greater size than would be successfully separated by the inner cyclone 12. The circumference of the shroud 31 was 25.5 inches (647 mm), the diameter was 8.11 inches (206 mm) and the height was 2.32 inches (59 mm). It was believed that the greater the total area of holes the less pressure there would be at each hole. This would have two effects. Firstly, the shroud 31 would be better at not attracting fluff. A build up of fluff on the shroud 31 does not activate the valve member 46 because fluff is so porous that it does not restrict the airflow. Secondly, a lower pressure at each opening 33 would make it easier for fine dust to gather at and maybe block the holes in the shroud 31. This latter tendency should be encouraged because such a blocking, being not porous, does effectively activate the valve member 46.

2. Thickness of Material For the Shroud 31

It was found that better results were obtained when material at least 2 mm thick was used for the shroud 31. Material 1 mm thick did not work as well. It was assumed that the thicker material causes a sharper change in direction for the clean air and therefore contributes to a better separation than is achieved by the thinner material.

3. Dimension From Top of Valve Member 46 To the Ring Stop 47

This dimension was found to directly affect the sensitivity of the valve member 46. Too small a dimension caused early shut off or shut off when the air supply is temporarily blocked—such as putting your hand over the end of the inlet passage 18. Too large a dimension caused the valve member 46 to be too insensitive causing the valve member 46 to not shut off at the correct point. A dimension of 1.77 inches (45 mm) was preferred. A foam rubber seal (not shown) was used on top of the valve member 46 to seal with the stop 47.

4. Weight of Valve Member 46

This too was found to be important to the sensitivity of the valve member 46. Too light a valve member 46 caused early shut off or shut off when the air supply was temporarily blocked—such as putting your hand over the end of the inlet passage 18. Too heavy a valve member 46 caused the valve member 46 to be too insensitive causing the valve member 46 to not shut off at the correct point. A weight of 19.36 grams was used for the cleaner discussed above.

5. Means of Airflow Access To Housing 38

5.1 Direct Access to Valve Chamber

An area of openings 43 in the shroud 31 provides direct access to the housing 38. It was found that different results could be achieved by varying the number of those openings 43, although the valve member 46 worked successfully with sawdust, whatever number of openings 43 existed.

All Openings 43 Open—Result—All air becomes "direct" air, i.e. it goes straight into the housing 38 without passing through the other openings 33 in the shroud 31. Fine powder (such as the kaolin used in our tests) passes straight through the system overfilling the inner cyclone 12 receiving chamber 13 which in turn caused a blow out of dust from the inner cyclone 12. Secondly fluff is drawn into the holes in the shroud 31 having direct access to the housing 38 causing premature shut off.

5.2 All Openings 43 Closed—Result—With fine dust valve member 46 would not shut off. With fluff the valve member 46 would not shut off. The shroud 31 does not become clogged, it remains clear and therefore does not provide the necessary restriction to actuate the valve member 46.

5.3 15 mm From Top Closed—Result—A partial closure of the openings 43 with direct access to the housing 38 causes a bifurcation of the airflow—causing part of it to pass through the shroud 31 and the other part to pass directly into the housing 38. This compares with the condition where none of those openings 43 are blocked, and substantially all the air tends to pass directly into the housing 38 thereby bypassing the shroud 31.

With kaolin—there only needs to be a comparatively small amount of kaolin sticking to the openings 43 with direct access to the housing 38 to actuate the valve member 46. Considering the difficulty in obtaining shut off with kaolin this is a good result.

With fluff—the bifurcation of the airflow described above where part of the airflow passes through the shroud 31, causes the shroud 31 to operate effectively and remain clear. However, the part of the airflow having direct access to the housing 38 causes a build up of fluff on that part of the openings 43 having direct access to the housing 38. This successfully actuates the shut off. The valve member 46 is actuated by a blocking of the remaining holes. This is contradictory to the results obtained with the "All Closed" condition where the valve member 46 is not successfully actuated to shut off. It would be expected that such a blocking of the remaining openings 43 would render the valve member 46 in the same condition as the "All Closed" condition. The conclusion from these results is that the valve member 46 is in a position of sensitive equilibrium which can be upset by a change in flow or pressure while the vacuum cleaner is running.

6. Opening 45 of Bottom Wall 44 of Housing 38. This opening 45 was 0.59 inches (15 mm) in diameter.
7. Gap Around Valve Member 46 in Housing 38, (or size of valve member 46 relative to the size of the housing 38). There was a 1 mm gap between the valve member 46 and the inside of the housing 38. The valve member 46 had overall dimensions 2.28 inches of (58 mm) by 0.94 inches (24 mm). The valve member 46 was 1.38 inches (35 mm) high.

It is intended that the foregoing description be only illustrative of the present invention and that the present invention be limited only to the hereinafter appended claims.

I claim:

1. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container and having an air outlet from the container at the upper portion of the container; and means for generating an airflow which passes sequentially through the dirty air inlet and the container, and depositing the dirt in the container and then exiting from the container through a clean air outlet the improvement in a dirt level sensing means comprising:

(a) a housing means mounted inside the container between the dirty air inlet and the clean air outlet and providing an air passage to the clean air outlet from the container, the housing means extending from an opening to the clean air outlet and having a plurality of perforations through the housing means which provide the air passage through which the air flows between the dirty air inlet and the clean air outlet; and (b) a valve means slideably mounted inside the housing means wherein some of the perforations in the housing means are below the valve means and wherein in operation of the cleaner, the valve means rests in the housing means with the airflow from the container passing through the perforations in the housing means that provide the air passage through the housing means, before entering the clean air outlet from the container as dirt is being accumulated in the container, and wherein when dirt in the container partially covers at least some of the perforations in the housing means thus reducing the air passage to the clean air outlet from the container, a pressure gradient occurs between the inside of the container and the air inlet to the cyclone so that the valve means moves in the housing means to close off the opening to the clean air outlet to stop the airflow to the clean air outlet from the container.

2. The apparatus of claim 1 wherein there are two cyclones, one of which is the container and wherein the housing means and valve means are mounted in the container and control flow to the other of the cyclones.

3. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and having an air outlet from the container at the upper portion of the container; a circular cross-sectioned cyclone having a longitudinal axis and mounted inside the container, the cyclone comprising a cyclone air inlet at an upper end and having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface, and a cyclone air outlet communicating with the interior of the cyclone adjacent the upper end of the cyclone; a dirt receiving extending from the cone opening; and means for generating an airflow which passes sequentially through the dirty air inlet, the container, the cyclone air outlet, the airflow rotating around the frusto-conical interior surface of the cyclone and depositing the dirt in the receiver the improvement which comprises:

(a) a shroud means providing a first air passage from the container to the air inlet to the cyclone and provided around the longitudinal axis of the cyclone, the shroud means having an annular ring means extending from the air inlet to the cyclone, radially around the longitudinal axis with an opening from the shroud means to the air inlet to the cyclone, wherein the annular ring means has a plurality of perforations leading to an enclosed space inside the shroud means for providing the first air passage to the air inlet to the cyclone; and (b) a dirt level sensing means providing a second air passage from the container to the air inlet to the cyclone and partially mounted in the enclosed space of the shroud means in communication with the opening from the shroud means to the air inlet to the cyclone, the dirt level sensing means including a housing means and a valve means slideably mounted in the housing means, wherein the housing means has a plurality of perforations that provide the second air passage to the air inlet to the cyclone with at least some of the perforations in the housing means below the valve means and wherein in operation of the cleaner, the valve means rests in the housing means with the airflow from the container passing through the first air passage through the perforations in the annular ring of the shroud means and the second air passage through the housing means before entering the air inlet to the cyclone as dirt is being accumulated in the container, and when dirt in the container partially covers at least some of the perforations of the annular ring of the shroud means thus reducing the first and the second air passages to the air inlet to the cyclone, a pressure gradient occurs between the inside of the container and the air inlet to the cyclone so that the valve means moves in the housing means to close off the opening from the shroud means to the air inlet to the cyclone to stop the airflow to the air inlet to the cyclone from the container.

4. The apparatus of claim 3 with a vacuum motor mounted around the axis at the air outlet from the cyclone.

5. The apparatus of claim 4 wherein a cover with perforations for air removal from the cleaner is mounted on a lip at an open end of the container above the air outlet from the cyclone and around the motor.

6. The apparatus of claim 5 wherein the cover, motor, air inlet, cyclone and shroud means with the sensing means are removable as a unit from the container and wherein a seal is provided on the cover which rests on the lip of the container.

7. The apparatus of claim 3 wherein the shroud means is formed with the annular ring forming an outside wall of the shroud means, spaced from and parallel to the longitudinal axis and with the annular ring spaced from the inside surface of the container towards the longitudinal axis, the shroud means having an inside wall formed in part by the outside surface of the cyclone and wherein the opening from the shroud means to the air inlet to the cyclone has smaller dimensions than the valve means so that the valve means closes and seals the opening from the shroud means to the air inlet of the cyclone.

8. The apparatus of claim 7 wherein a portion of the housing means includes a portion of the annular ring.

9. The apparatus of claim 8 wherein the housing means and the valve means have arcuate shaped sides around the axis of the cyclone.

10. The apparatus of claim 2 wherein the dirt level sensing means is positioned below the inlet to the container.

11. The apparatus of claim 10 wherein the shroud means is formed with the annular ring forming an outside wall of the shroud means, spaced from and parallel to the longitudinal axis and with the annular ring spaced from the inside surface of the container towards the longitudinal axis, the shroud means having an inside wall formed in part by the outside surface of the cyclone and wherein the opening from the shroud means to the air inlet to the cyclone has smaller dimensions than the valve means so that the valve means closes and seals the opening from the shroud means to the air inlet of the cyclone.

12. The apparatus of claim 11 wherein a portion of the housing means includes a portion of the annular ring.

13. The apparatus of claim 12 wherein the housing means and the valve means have arcuate shaped sides around the axis of the cyclone.

14. The apparatus of claim 13 with a vacuum motor mounted around the axis at the air outlet from the cyclone.

15. The apparatus of claim 14 wherein a cover with perforations for air removal from the cleaner is mounted on a lip at an open end of the container above the air outlet from the cyclone and around the motor.

16. The apparatus of claim 15 wherein the cover, motor, air inlet, cyclone and shroud means with the sensing means are removable as a unit from the container and wherein a seal is provided on the cover which rests on the lip of the container

17. The apparatus of claim 3 wherein the valve means is made of a plastic.

18. The apparatus of claim 3 wherein the bottom of the housing means is provided with an opening which causes the valve means to move in the housing means to close the inlet to the cyclone.

19. The apparatus of claim 18 wherein a ratio of area of the perforations in the housing means and the opening in the housing means is between about 8 to 1 to 19 to 1.

20. The apparatus of claim 3 wherein a side of the housing means is provided with an opening which causes the valve means to move in the housing means to close the inlet to the cyclone.

21. The apparatus of claim 19 wherein the shroud means is formed with the annular ring forming an outside wall of the shroud means, spaced from and parallel to the longitudinal axis and with the annular ring spaced from the inside surface of the container towards the longitudinal axis, the shroud means having an inside wall formed in part by the outside surface of the cyclone and wherein the opening from the shroud means to the air inlet to the cyclone has smaller dimensions than the valve means so that the valve means closes and seals the opening from the shroud means to the air inlet of the cyclone.

22. The apparatus of claim 21 wherein a portion of the housing means includes a portion of the annular ring.

23. The apparatus of claim 22 wherein the housing means and the valve means have arcuate shaped sides around the axis of the cyclone.

24. The apparatus of claim 23 with a vacuum motor mounted around the axis at the air outlet from the cyclone.

25. The apparatus of claim 24 wherein a cover with perforations for air removal from the cleaner is mounted on a lip at an open end of the container above the air outlet from the cyclone and around the motor.

26. The apparatus of claim 22 wherein the cover, motor, air inlet, cyclone and shroud means with the sensing means are removable as a unit from the container and wherein a seal is provided on the cover which rests on the lip of the container.

27. The apparatus of claim 1 wherein the housing means and valve means have arcuate shaped sides around the axis of the cyclone.

28. The apparatus of claim 27 with a vacuum motor mounted around the axis at the air outlet from the cyclone.

29. The apparatus of claim 28 wherein a cover with perforations for air removal from the cleaner is mounted on a lip at an open end of the container above the air outlet from the container and around the motor.

30. The apparatus of claim 28 wherein the cover, and motor with the housing means and valve means are removable as a unit from the container and wherein a seal is provided on the cover which rests on the lip of the container.

31. The apparatus of claim 1 wherein the shroud means is comprised of a web means having an inside diameter mounted around the clean air outlet with the perorated annular ring means extending from a second larger diameter of the web means to a plate means which completes the shroud means with the opening from the shroud means to the clean air outlet from the container provided in the plate means.

32. The apparatus of claim 7 wherein the shroud means is comprised of a first web means having an inside diameter mounted around the cyclone and the annular ring means extending from a second larger diameter of the first web means, radially around the longitudinal axis to a second web means which extends between the annular ring means and the cyclone to complete the shroud means with the first web means providing for the opening from the shroud means to the air inlet to the cyclone.

33. The apparatus of claim 11 wherein the shroud means is comprised of a first web means having an inside diameter mounted around the cyclone and the annular ring means extending from a second larger diameter of the first web means, radially around the longitudinal axis to a second web means which extends between the annular ring means and the cyclone to complete the shroud means with the first web means providing for the opening from the shroud means to the air inlet to the cyclone.

34. The apparatus of claim 21 wherein the shroud means is comprised of a first web means having an inside diameter mounted around the cyclone and the annular ring means extending from a second larger diameter of the first web means, radially around the longitudinal axis to a second web means which extends between the annular ring means and the cyclone to complete the shroud means with the first web means providing for the opening from the shroud means to the air inlet to the cyclone.

35. The apparatus of claim 3 wherein the housing means is comprised of at least one sidewall extending from a bottom wall to the opening to the air inlet of the cyclone and wherein the bottom wall has at least one perforation and wherein the sidewall has a plurality of perforations with at least some of the perforations below the valve means wherein the valve means is in the position to close off the opening from the shroud means to the air inlet to the cyclone.

36. The apparatus of claim 34 wherein the sidewall of the housing is comprised of a pair of spaced apart lateral walls extending from the bottom wall with end walls between the lateral walls wherein the bottom wall has at least one perforation and the lateral walls and the sidewalls have a plurality of perforations, the perforations providing the second air passage to the air inlet of the cyclone.

37. The apparatus of claim 35 wherein a portion of the sidewall of the housing extends below the shroud means.

* * * * *

UNITED STATES PATENT AND TRADEMARK OFFICE

CERTIFICATE OF CORRECTION

PATENT NO. : 5,062,870

DATED : November 5, 1991

INVENTOR(S) : James Dyson

It is certified that error appears in the above-identified patent and that said Letters Patent is hereby corrected as shown below:

Column 7, line 22, after "243" and before "A", insert a period --.--.

Column 7, line 26, "246" should be --146--.

Column 9, line 45, after "possible" and before "Where", insert a period --.--.

Column 12, line 29, "receiving" should be --receiver--.

Column 13, line 38 (Claim 10), "Claim 2" should be --Claim 3--.

Column 14, line 66 (Claim 31), "perorated" should be --perforated--.

Column 16, line 16 (Claim 36), "Claim 34" should be --Claim 35--.

Signed and Sealed this

Fourth Day of May, 1993

*Attest:*

*Attesting Officer*

Michael K. Kirk

MICHAEL K. KIRK

*Acting Commissioner of Patents and Trademarks*